US008282240B2

(12) United States Patent
Xiao et al.

(10) Patent No.: US 8,282,240 B2
(45) Date of Patent: Oct. 9, 2012

(54) LED LAMP WITH HEAT DISSIPATION STRUCTURE

(75) Inventors: Xin-Jian Xiao, Shenzhen (CN); Shih-Hsun Wung, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 572 days.

(21) Appl. No.: 12/486,734

(22) Filed: Jun. 17, 2009

(65) Prior Publication Data

US 2010/0226137 A1 Sep. 9, 2010

(30) Foreign Application Priority Data

Mar. 7, 2009 (CN) ..... 2009 1 0300748

(51) Int. Cl.
*F21S 4/00* (2006.01)

(52) U.S. Cl. ..... 362/249.02; 362/249.01; 362/294; 362/368; 362/373

(58) Field of Classification Search ..... 362/368, 362/373, 249.01, 249.02, 249.08, 249.11, 362/249.16, 255, 294, 800, 806
See application file for complete search history.

(56) References Cited

U.S. PATENT DOCUMENTS

| | | | | |
|---|---|---|---|---|
| 4,974,128 | A * | 11/1990 | Prickett | 362/145 |
| 4,975,121 | A * | 12/1990 | Sakuta et al. | 106/724 |
| 5,249,108 | A * | 9/1993 | Gary | 362/388 |
| 5,567,036 | A * | 10/1996 | Theobald et al. | 362/485 |
| 6,525,668 | B1 * | 2/2003 | Petrick | 340/815.45 |
| 6,991,351 | B1 * | 1/2006 | Petrick | 362/373 |
| 7,329,033 | B2 * | 2/2008 | Glovatsky et al. | 362/547 |
| 7,611,264 | B1 * | 11/2009 | Chang et al. | 362/249.02 |
| 7,621,662 | B1 * | 11/2009 | Colbert | 362/493 |
| 7,832,899 | B2 * | 11/2010 | Zheng | 362/249.02 |
| 7,874,702 | B2 * | 1/2011 | Shuai et al. | 362/294 |
| 7,922,363 | B2 * | 4/2011 | Yang et al. | 362/294 |
| 2006/0001384 | A1 * | 1/2006 | Tain et al. | 315/246 |
| 2007/0159828 | A1 * | 7/2007 | Wang | 362/294 |
| 2007/0230172 | A1 * | 10/2007 | Wang | 362/249 |
| 2007/0230184 | A1 * | 10/2007 | Shuy | 362/294 |
| 2008/0316755 | A1 * | 12/2008 | Zheng et al. | 362/373 |
| 2009/0116233 | A1 * | 5/2009 | Zheng et al. | 362/234 |
| 2009/0296411 | A1 * | 12/2009 | Chang et al. | 362/373 |
| 2009/0303717 | A1 * | 12/2009 | Long et al. | 362/249.02 |

FOREIGN PATENT DOCUMENTS

CN 201014245 Y 1/2008

* cited by examiner

*Primary Examiner* — Mary McManmon
(74) *Attorney, Agent, or Firm* — Altis Law Group, Inc.

(57) ABSTRACT

An LED lamp comprises a supporting base, a number of heat dissipation structures, a number LEDs and a transparent envelope covering the heat dissipation structures and the LEDs therein. Each heat dissipation structure comprises a bottom plate and a lateral plate extending upwardly from the bottom plate. The bottom plates are mounted on a top surface of the supporting base and surround a regular shaped zone on the top surface of supporting base. The lateral plates spacingly surround the regular shaped zone. The lateral plates each comprises an inner surface facing the regular shaped zone and an outer surface facing away from the regular shaped zone. The LEDs each are mounted on the outer surface of the lateral plate of each heat dissipation structure.

14 Claims, 3 Drawing Sheets

LED LAMP WITH HEAT DISSIPATION STRUCTURE

BACKGROUND

1. Technical Field

The disclosure relates to light emitting diode (LED) lamps and, particularly, to an LED lamp with a heat dissipation structure which can effectively dissipate heat generated by the LED lamp.

2. Description of Related Art

As an energy-efficient light, an LED lamp has a trend of substituting for a traditional fluorescent lamp for indoor lighting purpose. In order to increase lighting brightness, a plurality of LEDs is often incorporated into a single lamp, in which how to efficiently dissipate heat generated by LEDs becomes a challenge.

Conventionally, an LED lamp comprises a cylindrical enclosure functioning as a heat sink and a plurality of LEDs mounted on an outer wall of the enclosure. The LEDs are arranged in a plurality of lines along a height direction of the enclosure and around the enclosure. The enclosure defines a central through hole oriented along the height direction thereof. When the LEDs are activated to lighten, heat generated by the LEDs is dispersed to ambient air via the enclosure by natural air convection. However, the cylindrical enclosure may be bulky and cause the LED lamp having an unattractive appearance.

What is needed, therefore, is an LED lamp with a heat dissipation structure which can overcome the described limitations.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
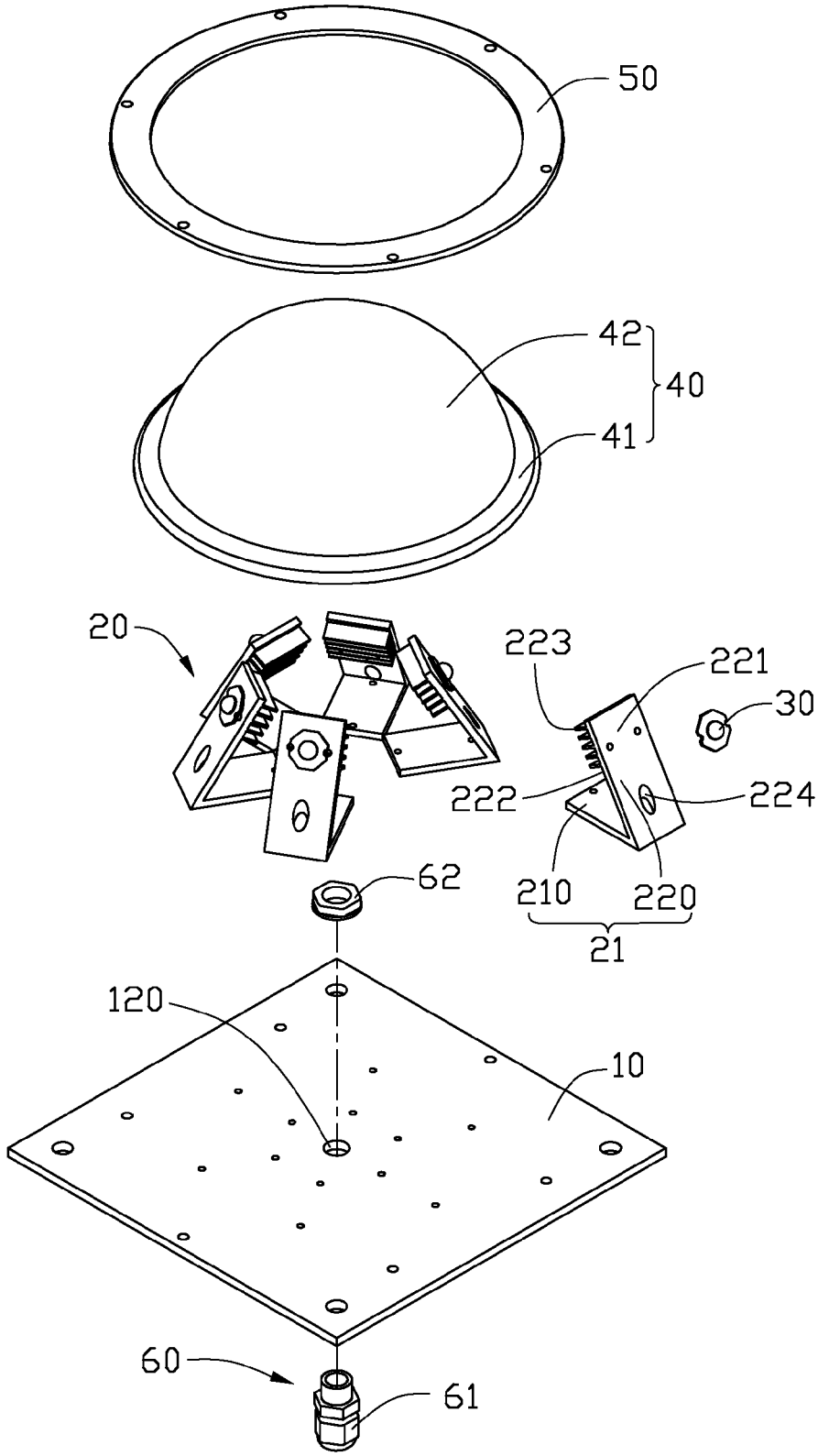
FIG. 1 is an isometric, exploded view of an LED lamp in accordance with an embodiment of the disclosure.
Figure 2:
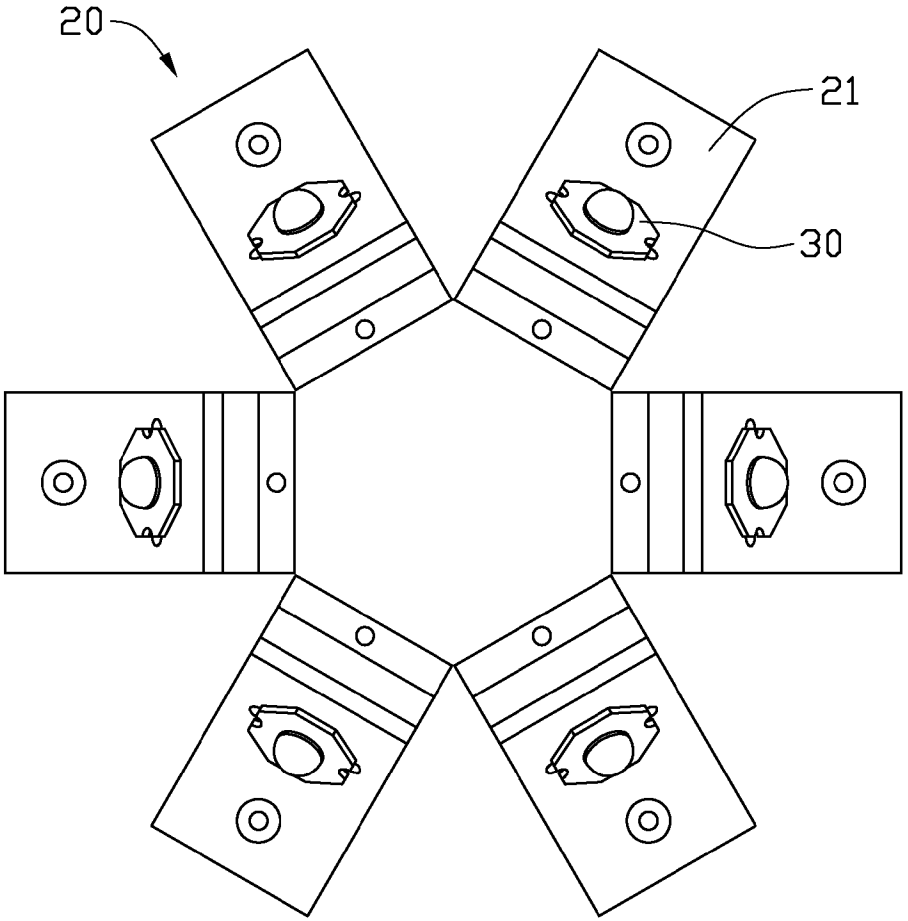
FIG. 2 is a top view of an arrangement of a plurality of heat dissipation structures in the LED lamp of FIG. 1.

Referring to FIG. 1 and FIG. 2, an embodiment of an LED lamp includes a supporting base 10, a heat dissipation assembly 20, six LEDs 30, a transparent envelope 40 and a retaining ring 50. The heat dissipation assembly 20 and the six LEDs 30 are mounted to a top surface of the supporting base 10 and covered by the transparent envelope 40. The retaining ring 50 is mounted to the top surface of the supporting base 10 to secure the transparent envelope 40 to the top surface of the supporting base 10.

The heat dissipation assembly 20 includes six heat dissipation structures 21 evenly and equidistantly arranged on the supporting base 10 around a center of the supporting base 10. Each heat dissipation structure 21 has a unitary structure made by a metal extrusion process. For example, each heat dissipation structure 21 is an aluminum extrusion product which includes a bottom plate 210 horizontally contacting the top surface of the supporting base 10 and a lateral plate 220 extending slantwise and upwardly from an outer end of the bottom plate 210 toward an inner end of the bottom plate 210. In the illustrated embodiment, the lateral plate 220 of each heat dissipation structure 21 angled with the corresponding bottom plate 210 at an acute angle. It is understood that the angle which the lateral plate 220 of each heat dissipation structure 21 inclines to the corresponding bottom plate 210 can be varied according to a desired lighting requirement.

The lateral plate 220 includes an outer surface 221 facing away from the bottom plate 21 and an inner surface 222 facing the bottom plate 21. One LED 30 is attached to the outer surface 221 of each heat dissipation structure 21, and a plurality of parallel fins 223 protrudes from the inner surface 222 of the lateral plate 220 of each heat dissipation structure 21, whereby heat generated by the LED 30 is absorbed by the lateral plate 220 and dissipated to ambient air through the fins 223. Advantageously, a position of the fins 223 located at the inner surface 222 corresponds to a position of the LED 30 located at the outer surface 221. In this manner, heat generated by the LED 30 can be quickly transferred to the fins 223 and effectively dissipated to ambient air through the fins 223.

Figure 3:
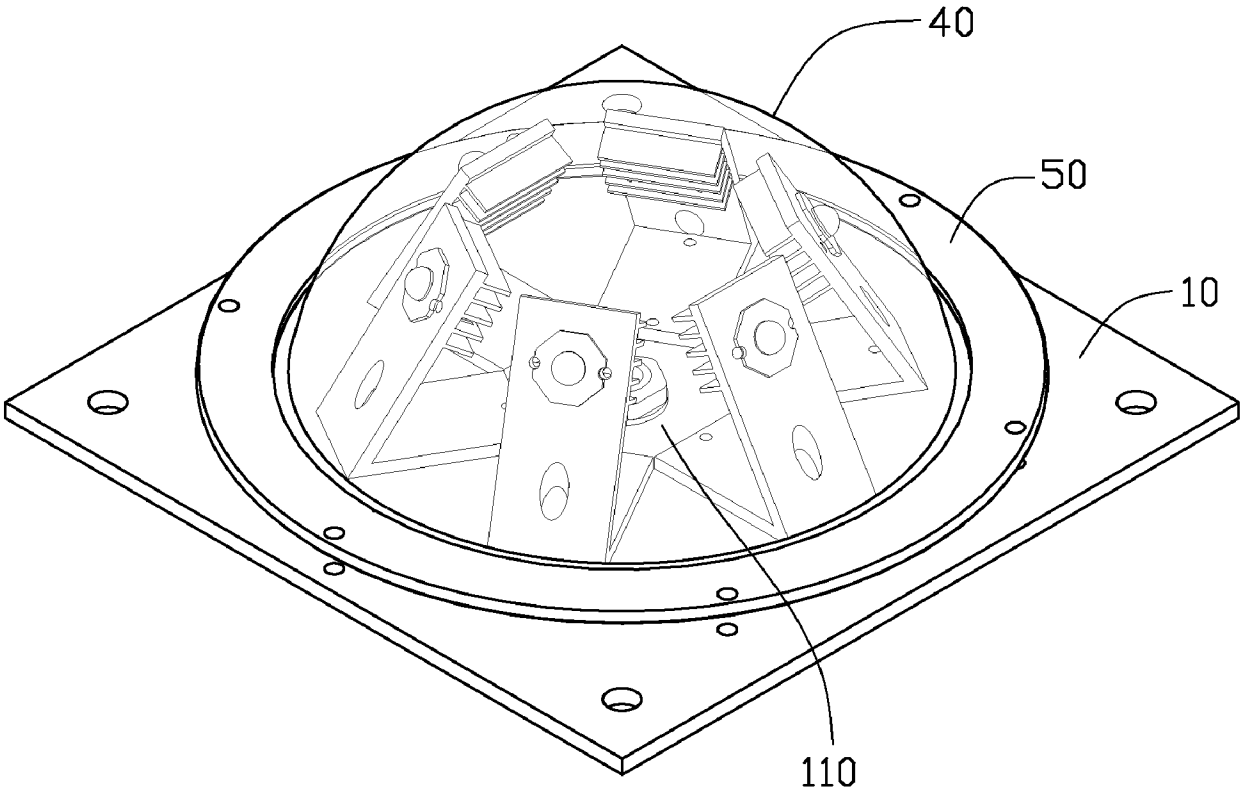
FIG. 3 is an assembled view of the LED lamp of FIG. 1.

The inner ends of the bottom plates 210 of the six heat dissipation structures 21 sequentially adjoin with one another to enclose a zone of a regular polygon on the top surface of the supporting base 10, for example, a regular, hexagonal zone 110 as shown in FIG. 3. The lateral plates 220 of the six heat dissipation structures 21 spacingly surround the hexagonal zone 110. The inner surfaces 222 of the lateral plates 220 of the six heat dissipation structures 21 face the regular, hexagonal zone 110. The outer surfaces 221 of the lateral plates 220 of the six heat dissipation structures 21 face away from the regular, hexagonal zone 110 and are oriented towards various directions relative to a center of the regular, hexagonal zone 110 of the supporting base 10. Accordingly, the LEDs 30 attached to the outer surfaces 221 emit light towards various directions relative to the center of the regular, hexagon zone 110 of the supporting base 10. Thus, a three-dimensional light source is formed to increase illumination effect. It is understood that the number of the heat dissipation structures 21 and the LEDs 30 are not limited to be six, and therefore the bottom plates 210 of the heat dissipation structures 21 can surround other regular, polygonal zones, for example, a regular, octagonal zone.

The supporting base 10 defines a void 120 for receiving a waterproof connector 60 therein. The waterproof connector 60 can prevent water or dirt from entering a body of the LED lamp to short-circuit or contaminate the heat dissipation structures 21 or the LEDs 30. The waterproof connector 60 includes a bead-like body 61 and a nut 62 engaging the bead-like body 61. An engaging end (not labeled) of the bead-like body 61 extends through the void 120 of the supporting base 10, and the nut 62 is screwed on the engaging end of the bead-like body 61, whereby the waterproof connector 60 is secured to the supporting base 10. A passage is defined in the waterproof 60 along an axial direction thereof for extension of wires (not shown) therethrough to electrically connect the LEDs 30 with a power supply (not shown). The six heat dissipation structures 21 each define a through hole 224 for allowing the wires passing therethrough to electrically connect the LEDs 30 with the power supply.

The transparent envelope 40 includes an arc-shaped transparent body 42 and an annular flange 41 extending outwardly formed an edge of the transparent body 42. The transparent body 42 is used to cover the heat dissipation structures 21 and the LEDs 30 therein, and therefore a shape thereof is not limited to be arc. The flange 41 is horizontally disposed on the top surface of the supporting base 10, and the retaining ring 50 is fixed to the top surface of the supporting base 10 to sandwich the flange 41 between the retaining ring 50 and the supporting base 10. The retaining ring 50 defines a plurality of through holes (not labeled) therein, the supporting base 10 defines a plurality of screw holes (not labeled) corresponding to the through holes of the retaining ring 50. A plurality of screws (not shown) is provided to mount the retaining ring 50 to the supporting base 10 by sequentially extending the screws through the through holes and screwing the screws in the screw holes of the supporting base 10.

Regarding the LED lamp, each heat dissipation structure 21 is a small-sized aluminum extrusion product, so each heat dissipation structures 21 and the LED 30 attached thereon construct a small-sized LED module. A plurality of small-sized LED modules can be arranged to surround zones with various shapes (e.g., rectangular, hexagonal, octagonal and so on) to achieve various light sources. In the illustrated embodiment, the small-sized LED modules surround a regular, hexagonal zone 110 on the top surface of the supporting base 10, whereby light beams generated by the LEDs 30 radiate at various directions relative to the center of the regular, hexagonal zone 110. It is understood that if the small-sized LED modules have a sufficiently large number, they can surround a nearly circular zone. Light beams generated by the LEDs 30 radiate at every and various directions relative to the center of the nearly circular zone and form an effect of a 360 degree illumination.

It is to be understood, however, that even though numerous characteristics and advantages of the present embodiments have been set forth in the foregoing description, together with details of the apparatus and function of the embodiments, the disclosure is illustrative only, and changes may be made in detail, especially in matters of shape, size, and arrangement of parts within the principles of the embodiments to the full extent indicated by the broad general meaning of the terms in which the appended claims are expressed.

The invention claimed is:

1. An LED lamp comprising:

a supporting base;

a plurality of heat dissipation structures each comprising a bottom plate and a lateral plate extending upwardly and slantwise from the bottom plate, the bottom plates of the heat dissipation structures having inner ends adjacent to each other and close to a center of the supporting base and outer ends distant from the center of the supporting base in comparison with the inner ends, wherein the bottom plates of the heat dissipation structures are mounted on a top surface of the supporting base and surround a regular shaped zone on the top surface of supporting base, the lateral plates of the heat dissipation structures are separated from each other with a space defined between every two neighboring lateral plates and surround the regular shaped zone, the lateral plates of the heat dissipation structures each comprise an inner surface facing the regular shaped zone and an outer surface facing away from the regular shaped zone;

an LED mounted on the outer surface of each of the lateral plates of the heat dissipation structures so that heat generated by the LED can be absorbed by each of the lateral plates; and a transparent envelope disposed on the top surface of the supporting base to cover the heat dissipation structures and the LEDs attached on the heat dissipation structures therein;

wherein the lateral plates of the heat dissipation structures are extended from the outer ends of the bottom plates, respectively and slantwise toward each other along a bottom-to-top direction of the LED lamp; wherein the heat dissipation structures each are a unitary structure.

2. The LED lamp of claim 1, wherein the heat dissipation structures each are made by a metal extrusion process.

3. The LED lamp of claim 2, wherein the heat dissipation structures each are an aluminum extrusion product.

4. The LED lamp of claim 1, wherein the inner ends of the bottom plates of the heat dissipation structures sequentially adjoin with one another to enclose the regular shaped zone on the top surface of the supporting base.

5. The LED lamp of claim 1, wherein the inner surface of the lateral plate of each of the heat dissipation structures protrudes a plurality of parallel fins.

6. The LED lamp of claim 5, wherein a position of the fins located at the inner surface corresponds to a position of the LED located at the outer surface of each of the lateral plates so that heat generated by the LED can be quickly dissipated by the fins.

7. The LED lamp of claim 5, further comprising a retaining ring mounted to the top surface of the supporting base to secure the transparent envelope to the top surface of the supporting base.

8. An LED lamp comprising:

a supporting base;

a plurality of LED modules mounted on a top surface of the supporting base, each of the LED modules comprising:

a heat dissipation structure comprising a bottom plate and a lateral plate extending slantwise and upwardly from the bottom plate, wherein the bottom plates of the heat dissipation structures of the LED modules are mounted on the top surface of the supporting base and surround a regular shaped zone on the top surface of supporting base, the lateral plates of the heat dissipation structures of the LED modules are separated from each other with a space defined between every two neighboring lateral plates and spacingly surround the regular shaped zone, the lateral plates of the heat dissipation structures each comprises an inner surface facing the regular shaped zone and an outer surface facing away from the regular shaped zone;

an LED mounted on the outer surface of each of the lateral plates of the heat dissipation structures, whereby the LEDs mounted on the outer surfaces of the lateral plates of the heat dissipation structures radiate light at various directions facing away from the regular shaped zone;

a transparent envelope disposed on the top surface of the supporting base to cover the LED modules therein; and a retaining ring mounted to the top surface of the supporting base to secure the transparent envelope to the top surface of the supporting base;

wherein inner ends of the bottom plates of the heat dissipation structures of the LED modules sequentially adjoin with each other to enclose the regular shaped zone on the top surface of the supporting base; wherein the heat dissipation structures each are a unitary stucture.

9. The LED lamp of claim 8, wherein the heat dissipation structures each are an aluminum extrusion product.

10. The LED lamp of claim 9, wherein the lateral plate of each of the heat dissipation structures extends slantwise and upwardly from an outer end of the bottom plate of each of the heat dissipation structures.

11. The LED lamp of claim 8, wherein the inner surface of the lateral plate of each of the heat dissipation structures protrudes a plurality of parallel fins.

12. The LED lamp n claim 11, wherein a position of the fins located at the inner surface corresponds to a position of the LED located at the outer surface so that heat generated by the LED can be quickly dissipated by the fins.

13. The LED lamp of claim 8, wherein the lateral plates of the heat dissipation structures are separated from each other.

14. An LED lamp comprising:

a supporting base;

a plurality of heat dissipation structures each comprising a bottom plate and a lateral plate extending upwardly and slantwise from the bottom plate, the lateral plates of the heat dissipation structure being slantwise toward each other along an upward direction, wherein the bottom plates of the heat dissipation structures are mounted on a top surface of the supporting base and surround a regular shaped zone on the top surface of supporting base, the lateral plates of the heat dissipation structures spacingly surround the regular shaped zone with a space defined between every two neighboring lateral plates, the lateral plates of the heat dissipation structures each comprise an inner surface facing the regular shaped zone and an outer surface facing away from the regular shaped zone, the inner surface of the lateral plate of each of the heat dissipation structures protrudes a plurality of parallel fins;

an LED mounted on the outer surface of each of the lateral plates of the heat dissipation structures so that heat generated by the LED can be absorbed by each of the lateral plates;

a transparent envelope disposed on the top surface of the supporting base to cover the heat dissipation structures and the LEDs attached on the heat dissipation structures therein; and a retaining ring mounted to the top surface of the supporting base to secure the transparent envelope to the top surface of the supporting base; wherein the heat dissipation stuctures each are a unitary structure.

* * * * *